United States Patent [19]

Bailey et al.

[11] Patent Number: 4,955,949

[45] Date of Patent: Sep. 11, 1990

[54] MUD SAVER VALVE WITH INCREASED FLOW CHECK VALVE

[75] Inventors: Thomas F. Bailey; Raymond A. Todd, Jr., both of Houston, Tex.

[73] Assignee: Drilex Systems, Inc., Houston, Tex.

[21] Appl. No.: 305,319

[22] Filed: Feb. 1, 1989

[51] Int. Cl.[5] ..... F16K 17/40

[52] U.S. Cl. ..... 137/71; 137/327; 137/493.9; 137/515; 166/317; 166/325

[58] Field of Search ..... 137/71, 327, 515, 493.9; 166/317, 325; 175/218

[56] References Cited

U.S. PATENT DOCUMENTS

| | | | |
|---|---|---|---|
| 3,698,411 | 9/1972 | Garrett | 137/71 |
| 3,965,980 | 6/1976 | Williamson | 137/496 |
| 3,967,679 | 7/1976 | Liljestrand | 137/71 |
| 4,128,108 | 12/1978 | Parker et al. | 137/327 |
| 4,364,407 | 12/1982 | Hilliard | 137/71 |
| 4,625,755 | 12/1986 | Reddoch | 137/327 |
| 4,658,905 | 4/1987 | Burge | 166/325 |
| 4,779,688 | 9/1988 | Baugh | 166/325 X |

*Primary Examiner*—Stephen M. Hepperle

*Attorney, Agent, or Firm*—Edgar A. Zarins; Malcolm L. Sutherland

[57] ABSTRACT

A mud saver valve for insertion within the drill string to retain mud in the drill pipe preventing the mud column from flowing past the valve when pumping is interrupted. The mud saver valve includes an internal check valve which permits increased flow of mud upward through the valve when a predetermined downhole pressure is reached. The increased flow of the check valve prevents a blow-out of the plug spear in the event sudden upward pressure is encountered. The check valve forms a part of the plug spear which is removable from the mud saver valve to facilitate the running of wireline tools.

20 Claims, 2 Drawing Sheets

MUD SAVER VALVE WITH INCREASED FLOW CHECK VALVE

BACKGROUND OF THE INVENTION

I. Field of the Invention

This invention relates to a fluid valve which allows the downward flow of drilling fluids but closes when pumps are off to retain the fluid within the drill pipe and, in particular, to a mud saver valve which includes a check valve to bleed off downhole pressure with an increased flow area to prevent blowout of the closure plug under extreme or sudden fluid pressure.

II. Description of the Prior Art

In the drilling of oil and gas wells, it is common practice to insert in the drill string between the kelly and the drill pipe a valve to retain mud in the kelly when the drill string is detached. The advantages of mud saver valves include saved mud cost, decreased chances of pollution, and increased safety to rig personnel. Most of the past known mud saver valves include a piston having an axial throughbore biased upwardly within the valve housing by a spring. When closed, the piston engages a closure plug which blocks mud flow through the piston and valve. As the surface pumps pump drilling mud through the drill string, the fluid pressure acts against the top of the piston and the force of the spring to open the fluid passageway through the valve. When mud flow is interrupted the spring forces the piston against the closure plug to close the passageway.

The closure plug is removable from the mud saver valve to permit the running of wireline tools through the drill string. Typically, the closure plug is provided with a spear head such that an overshot may be run to grasp the plug for removal. Many of the past known closure plugs also include a check valve to bleed off excess downhole fluid pressure when the valve is closed. However, such past known check valves utilize a simple ball valve having a small fluid capacity. In the event of sudden or extreme downhole fluid pressure, the ball check valves are not capable of accommodating the increased pressure and flow. Since the closure plugs are typically retained within the valve by shear screws, the extreme pressure has been known to blow the closure plug out of the valve resulting in mud flow to the rig surface and a potentially dangerous situation.

In addition, the ball-type check valves of the past known mud saver valves have a tendency to clog with drilling mud because of their limited fluid capacity. Heavier muds tend to accumulate within the flow passageway and on the movable ball and stem of the check valve. Since closure of the check valve is dependent upon cooperation of the ball with the valve seal, the accumulation of mud may prevent the check valve from closing when pressure has been substantially equalized.

SUMMARY OF THE PRESENT INVENTION

The present invention overcomes the disadvantages of the prior known mud saver valves by providing a mud valve with a closure plug having a check valve capable of accommodating an increased fluid flow to reduce the danger of plug blow-out in high pressure wells.

The mud saver valve of the present invention includes a tubular housing insertable within the drill string and housing a spring-biased piston having an axial fluid passageway. Removably secured within the top of the housing is a closure plug with a spearhead. The upper end of the housing includes an annular sleeve portion which engages the piston to prevent fluid flow through the valve. A spear sleeve is detachably connected to the upper end of the housing by a series of shear screws. A spear retainer forms a portion of the spear and telescopically engages the spear sleeve. The retainer includes at least one port which is opened as the spear extends telescopically with respect to the spear sleeve.

During downhole pumping of mud, the drilling mud flows around the closure plug and engages the top of the piston. When sufficient fluid pressure is attained to overcome the force of the spring, the fluid passageway through the valve will be opened. When pumping is interrupted, the piston will close the passageway preventing the drilling mud from flowing past the mud saver valve. In case of a sudden upward fluid pressure when the valve is closed or when the downhole pressure becomes greater than the fluid pressure above the valve, the check valve incorporated into the closure plug will open to relieve such pressure. As fluid pressure acts against the bottom of the spear the spear and the spear retainer will telescope upwardly to open the ports and relieve the downhole pressure. The check valve can also be utilized to relieve downhole pressure prior to removal of the spear from the closure plug using an overshot tool since the ports will be opened prior to removal of the spear.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
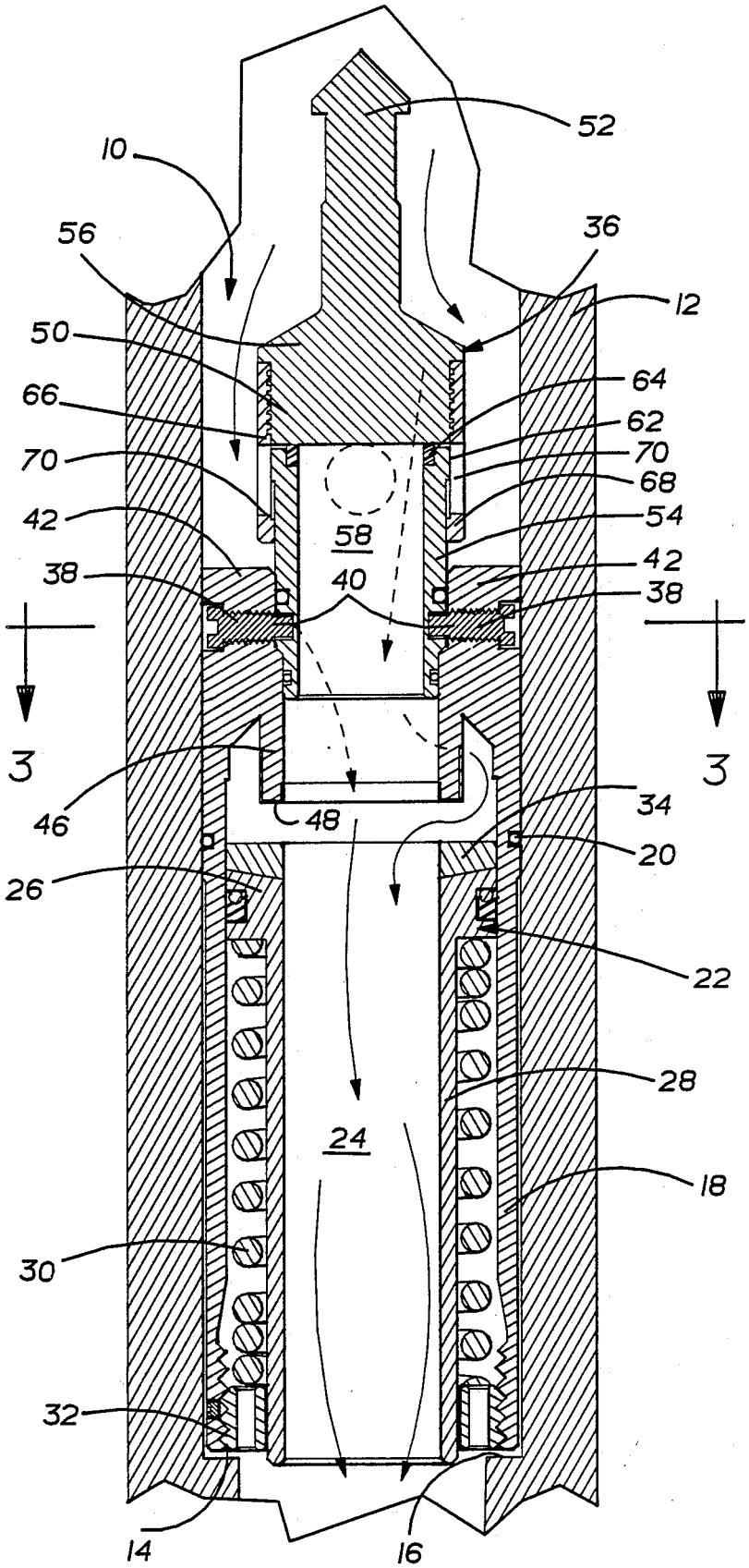
FIG. 1 is a cross-sectional perspective of a mud saver valve embodying the present invention in the open position to permit fluid flow through the valve.

Referring to the drawing, there is shown a mud saver valve 10 embodying the present invention and disposed within a drill string 12 used in well drilling. The mud saver valve 10 is designed to permit the downhole flow of drilling mud as it is pumped through the string 12 to operate downhole tools but prevent the drilling mud from flowing upwardly to the rig when pumping is interrupted or the string is disconnected. Preferably, the mud saver valve 10 is disposed in a radially enlarged portion 14 of a kelly saver sub such that the mud saver valve 10 is prevented from moving downhole by annular shoulder 16.

The mud saver valve 10 includes a tubular body 18 having a diameter approximately equal to the inside diameter of the string 12 and at least one outer seal 20 to prevent the flow of drilling mud around the mud saver valve 10. An axially movable piston 22 with a central fluid passageway 24 is mounted within the lower end of the tubular housing 18. The piston 22 includes a piston head 26 which sealingly engages the walls of the tubular housing 18 and a piston stem 28 extending downwardly therefrom. The passageway 24 extends through both the piston head 26 and stem 28. The piston 22 is biased upwardly against the downward flow of the drilling mud by a spring 30 disposed within the annulus between the piston stem 28 and the housing 18. The spring 30 engages the piston head 26 at its upper end and a retaining ring 32 mounted within the lower end of the tubular housing 18 for compression therebetween. The spring 30 urges the piston 22 upwardly when drilling mud is not being pumped through the valve 10 as will be subsequently described. In a preferred embodiment, the upper end of the piston 22 is provided with a replaceable wear-resistant ring 34 which is resistant to the erosive properties of the drilling mud.

Figure 3:
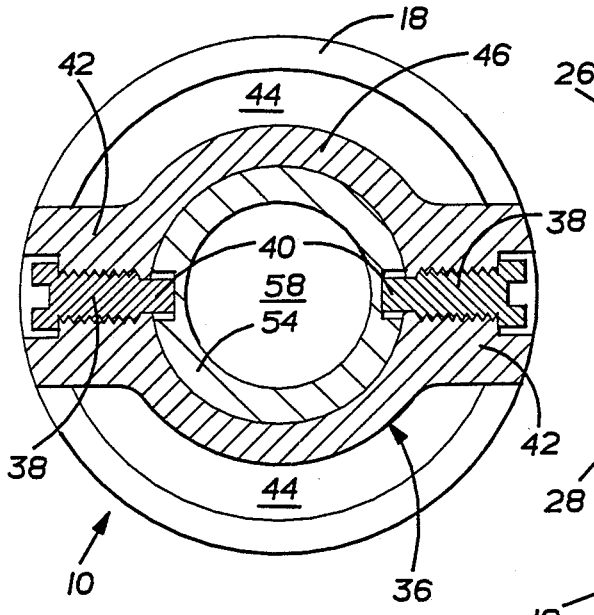
FIG. 3 is a cross-sectional view taken along lines 3—3 of FIG. 1.

Mounted within the upper end of the tubular housing 18 is a closure plug 36 which is engageable with the wear-resistant ring 34 of the piston 22 to prevent the flow of drilling mud through the valve 10. The closure plug 36 is supported within the upper end of the housing 18 by a pair of shear screws 38 which have a shearable end portion 40. The screws 38 extend through a pair of support arms 42 formed at the upper end of the housing 18. As best shown in FIG. 3, the opposing orientation of the support arms 42 form a pair of fluid passageways 44 on opposite sides of the closure plug 36 to permit the flow of drilling mud past the closure plug 36 into contact with the piston 22.

The closure plug 36 supported in the tubular housing 18 is replaceable by removing the screws 42 which extend through the support arms 42. The support arms 42 have an annular sleeve portion 46 extending therefrom. The lower end of the sleeve portion 46 may be provided with a carbide coating or cap 48 in order to withstand the erosive wear of the drilling mud flowing past the lower end of the sleeve portion 46 when the valve 10 is open. It is important that the lower end of the sleeve 46 sealingly engages the piston head 26 when the piston 22 is fully extended to prevent drilling mud from flowing through the valve.

Seated within the upper end of the mud saver valve 10 is a spear body 50 which is removable to allow wireline tools to be run through the mud saver valve 10. The spear 50 is retained within the sleeve portion 46 of the housing 18 by the shearable end portions 40 of the screws 38 extending through the support arms 42. The upper end of the spear body 50 is provided with a spear tip 52. Thus, if it becomes necessary to run a wireline tool through the valve 10, a conventional overshot tool may be run into the hole to engage the spear tip 52 and an upward force applied to the spear 50 shearing the screws 38 and removing the spear 50. Once removed, wireline tools may be run through the mud saver valve 10.

Figure 2:
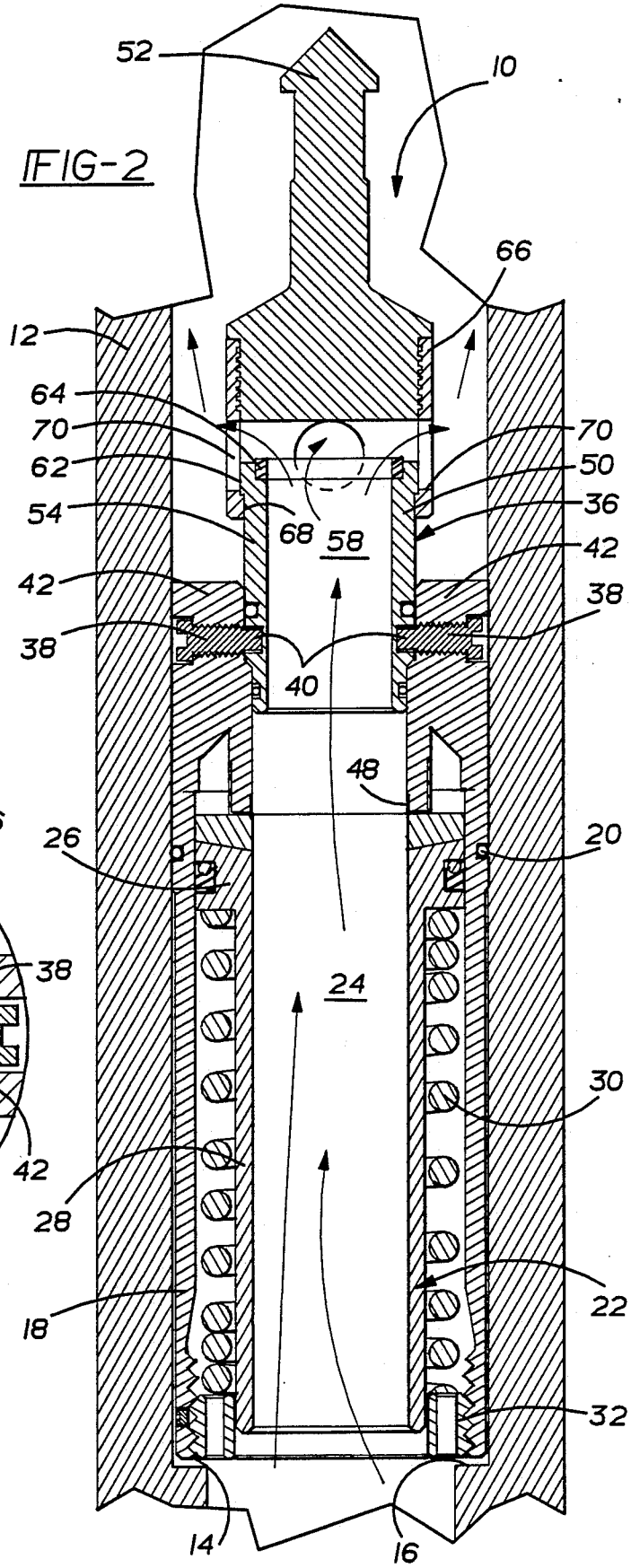
FIG. 2 is a cross-sectional perspective of the mud saver valve in the closed position with the check valve open to relieve downhole fluid pressure.

Referring still to FIGS. 1–3, the spear 50 includes a spear sleeve 54 received within the inner sleeve 46 and a spear head 56 telescopically mounted to the spear sleeve 54. Spear sleeve 54 has an axial fluid passageway 58 and outer cavities to receive the shearable end portions 40 of the shear screws 38. The spear sleeve 54 is provided with O-ring seals 60 to prevent fluid leakage between the spear sleeve 54 and the inner sleeve 46. The upper end of the spear sleeve 54 includes an annular retaining shoulder 62 extending circumferentially outwardly and a seal member 64 which engages the spear head 56 when the spear 50 is telescopically contracted.

The spear head 56 telescopically mounted to the spear sleeve 54 includes a retaining sleeve 66 threadably attached thereto and extending downwardly therefrom to matingly receive the spear sleeve 54. The lower end of the retaining sleeve 66 includes an annular retaining shoulder 68 extending circumferentially inwardly to engage the outer surface of the spear sleeve 54. Formed in the retaining sleeve 66 is at least one fluid port 70. In a preferred embodiment, the retaining sleeve 66 includes four circumferentially spaced ports 70 formed between the spear head 56 and the retaining shoulder 68 of the retaining sleeve 66. In this manner, as the ports 70 are exposed as a result of the telescoping action of the spear head 56 relative to the spear sleeve 54, the increased flow area provided by the ports 70 will relieve any amount of fluid pressure below the mud saver valve 10. The telescoping action of the spear 50 to expose the ports 70 forms the increased flow check valve for the mud saver valve 10.

Operation of the present invention permits the downhole flow of drilling mud when the mud is being pumped to operate downhole tools but prevents the flow of drilling mud through the valve when pumping is interrupted thereby retaining the mud column within the string while saving mud, decreasing pollution and providing a more favorable working environment for rig personnel. Nevertheless, the increased flow check valve of the present invention provides the capability to relieve extreme and sudden downhole pressure increases thereby preventing premature blow out of the spear and also providing for increased pressure equalization above and below the valve 10. Referring first to FIG. 1, as the drilling mud is pumped downhole, it will flow past the closure plug 36 through passageways 44 to engage the top of the piston 22. As fluid pressure increases, the piston 22 will be moved downward against the force of the spring 30 creating a gap between the sleeve 46 and the piston 22. The drilling mud can then flow into the fluid passageway 24 and out of the bottom of the mud saver valve 10. As long as drilling mud is being pumped through the drill string 12, the piston 22 will be maintained axially downward away from the lower end of the inner sleeve. As fluid flow is increased or decreased the gap between the piston 22 and the sleeve portion 46 will increase or decrease to accommodate the flow of drilling mud.

Referring now to FIG. 2, when the pumping of drilling mud is interrupted, the piston 22 will move upwardly to engage the sleeve 46 preventing fluid flow through the mud saver valve 10. In the event the interruption in pumping causes a sudden or extreme upsurge of drilling mud due to downhole pressures, the check valve will bleed the excess fluid pressure from within the mud valve 10. As the downhole fluids flow up through passageways 24 and 58 to engage the underside of spear head 56, the spear head 56 will telescopically extend opening the ports 70 to permit the fluid to flow uphole of the mud saver valve 10 thereby relieving the excess downhole pressure. Since the ports 70 are opened immediately as the spear head 56 moves upwardly and because of the large flow area of the ports 70, even sudden excessive pressure surges can be relieved without blowing out the spear 50. Moreover, the check valve equalizes the fluid pressure above and below the mud saver valve 10 prior to removal of the spear 50 from the sleeve portion 46 of the housing since as upward force is placed on the spear head 56, it will telescope upwardly to open the ports 70. Once the retaining shoulders 62 and 68 come into contact with each other, additional upward force will shear the screws 38 pulling the spear free of the inner sleeve 46.

The foregoing detailed description has been given for clearness of understanding only and no unnecessary limitations should be understood therefrom as some modifications will be obvious to those skilled in the art without departing from the scope and spirit of the appended claims.

I claim:

1. In a mud saver valve for retaining fluids within a drill string, the mud saver valve including a tubular body adapted to be disposed within the drill string and an axially movable piston having a fluid passageway and disposed within the tubular body, a closure plug mounted within the upper end of the mud saver valve, said closure plug comprising:

a removable spear body seated within the upper end of the mud saver valve, said spear body including a spear sleeve removably seated within the closure plug, a spear head telescopically receiving said spear sleeve, and check valve means;

the piston biased against the downhole flow of fluids to selectively engage said closure plug closing the fluid passageway, said spear head telescopically extending relative to said spear sleeve when fluid pressure downhole of said spear body exceeds a predetermined fluid pressure thereby opening said check valve means allowing fluid exceeding said predetermined fluid pressure to flow upwardly through said closure plug when the fluid passageway is closed, said spear sleeve including an outwardly disposed annular shoulder and said spear head including an inwardly disposed annular shoulder, telescoping extension of said spear head relative said spear sleeve limited by said cooperating shoulders formed on said spear head and said spear sleeve.

2. The closure plug as defined in claim 1 wherein said spear body is removable from the upper end of the mud saver valve by the application of an upward tension force such that wireline tools may be passed through the mud saver valve.

3. The closure plug as defined in claim 1 wherein said spear body is retained within the upper end of the mud saver valve by at least one shear screw extending through the upper end of the mud saver valve to engage said spear body.

4. The closure plug as defined in claim 1 wherein said check valve means includes at least one fluid port formed in said spear head, said at least one fluid port being opened as said spear head extends telescopically relative to said spear sleeve.

5. The closure plug as defined in claim 4 wherein said spear head includes a retaining sleeve extending therefrom, said at least one fluid port formed in said retaining sleeve, said retaining sleeve matingly receiving said spear sleeve.

6. The closure plug as defined in claim 5 wherein said spear sleeve and said retaining sleeve include cooperating annular shoulders to limit the telescoping movement of said spear head relative to said spear sleeve.

7. In a mud saver valve for retaining fluids within a drill string when pumping is interrupted, the mud saver valve including a tubular body adapted to be disposed within the drill string and an axially movable piston having a fluid passageway and disposed within the tubular body, the piston being biased against the downhole flow of fluid by a spring, a closure plug mounted within the upper end of the mud saver valve and selectively engageable with the piston to prevent the flow of fluid through the fluid passageway, said closure plug comprising:

a spear removably seated within the upper end of the mud saver valve, said spear including a spear sleeve detachably received within said upper end of the mud saver valve, a spear head telescopically mounted to said spear sleeve, and check valve means allowing fluid to flow upwardly through said closure plug when the fluid passageway is closed, said spear head telescopically extending relative to said spears sleeve when fluid pressure downhole of said closure plug exceeds a predetermined fluid pressure thereby opening said check valve means allowing fluid to flow upwardly through said closure plug, said spear sleeve including an outwardly disposed annular shoulder and said spear head including an inwardly disposed annular shoulder, said annular shoulders cooperating to limit the telescoping movement of said spear head relative to said spear sleeve.

8. The closure plug as defined in claim 7 wherein said spear head includes a downwardly depending retaining sleeve, said retaining sleeve matingly receiving said spear sleeve to telescopically mount said spear head to said spear sleeve.

9. The closure plug as defined in claim 8 wherein said check valve means includes at least one fluid port formed in said retaining sleeve of said spear head, said at least one port being opened as said spear head extends relative to said spear sleeve and said at least one port being closed as said spear head telescopically contracts relative to said spear sleeve, said spear head telescopically extending and contracting relative to said spear sleeve to allow fluid to flow upwardly through the mud saver valve when the fluid passageway is closed.

10. The closure plug as defined in claim 9 wherein said spear is retained within the upper end of the mud saver valve by at least one shear screw extending from the upper end of the mud saver valve to engage said spear sleeve.

11. A mud saver valve for retaining drilling mud within a drill string when downhole mud pumping is interrupted, said mud saver valve adapted to be disposed within a radially enlarged portion of the drill string, said mud saver valve comprising:

a tubular body;

an axially movable piston having a central fluid passageway disposed within said tubular body, said piston biased by a spring against the downhole flow of drilling mud;

closure means supported in the upper end of said tubular body and selectively engageable with said piston, the downhole flow of drilling mud through said fluid passageway being prevented when said piston is biased into engagement with said closure means;

a spear removably seated within the upper end of said tubular body said spear including a spear sleeve and a spear head said spear head telescopically receiving said spear sleeve within said spear head said spear head and spear sleeve having cooperating shoulder means for limiting telescopic extension of said spear head relative to said spear sleeve;

check valve means in said spear, said spear head extending telescopically relative to said spear sleeve to open said check valve means allowing drilling mud to flow upwardly through said mud saver valve when said fluid passageway is closed and the fluid pressure of the drilling mud downhole of said mud saver valve exceeds a predetermined pressure.

12. The mud saver valve as defined in claim 11 wherein said spear head includes a retaining sleeve, said retaining sleeve matingly receiving said spear sleeve to telescopically connect said spear head to said spear sleeve.

13. The mud saver valve as defined in claim 12 wherein said spear sleeve and said retaining sleeve include cooperating annular retaining shoulders to limit the telescoping extension of said spear head relative to said spear sleeve.

14. The mud saver valve as defined in claim 13 wherein said check valve means comprises at least one fluid port formed in said retaining sleeve of said spear head, said at least one port being selectively opened and closed by the telescoping movement of said spear head relative to said spear sleeve, said at least one port being opened as said spear head extends from said spear sleeve.

15. The mud saver valve as defined in claim 14 wherein said spear is removably retained within the upper end of said tubular body by at least one shear screw extending through the upper end of said tubular body, said at least one screw including a shearable end portion engaging said spear.

16. A mud saver valve for retaining drilling mud within a drill string when downhole mud pumping is interrupted, said mud saver valve adapted to be disposed within a radially enlarged portion of the drill string, said mud saver valve comprising:

a tubular body;

an axially movable piston having a central fluid passageway disposed within said tubular body, said piston biased by a spring against the downhole flow of drilling mud;

closure means supported in the upper end of said tubular body and selectively engageable with said piston, said piston disengaging from said closure means when the mud is pumped downhole through said mud saver valve and the downhole flow of drilling mud through said fluid passageway prevented when said piston is biased into engagement with said closure means;

a spear removably seated within the upper end of said tubular body by at least one shear screw extending through the upper end of said tubular body, said spear including a spear sleeve and a spear head having a retaining sleeve telescopically receiving said spear sleeve; and check valve means in said spear, said spear head extending telescopically relative to said spear sleeve to open said check valve means allowing drilling mud to flow upwardly through said mud saver valve when said fluid passageway is closed and the fluid pressure of the drilling mud downhole of said mud saver valve exceeds a predetermined pressure, said spear sleeve including an inward retaining shoulder and said retaining sleeve including a cooperating outward retaining shoulder to limit the telescoping extension of said spear head relative to said spear sleeve.

17. The mud saver valve as defined in claim 16 wherein said check valve means comprises at least one fluid port formed in said retaining sleeve of said spear head, said at least one port being selectively opened and closed by the telescoping movement of said spear head relative to said spear sleeve, said at least one port being opened as said spear head extends from said spear sleeve.

18. In a mud saver valve for retaining fluids within a drill string when pumping is interrupted, the mud saver valve including a tubular body adapted to be disposed within the drill string and an axially movable piston having a fluid passageway and disposed within the tubular body, the piston being biased against the downhole flow of fluid by a spring, a closure plug mounted within the upper end of the mud saver valve and selectively engageable with said piston, the piston disengaging from the closure plug when mud is pumped downhole through the mud saver valve, said closure plug comprising:

a spear removably seated within the upper end of the mud saver valve, said spear including a spear sleeve detachably received within said upper end of the mud saver valve, a spear head telescopically mounted to said spear sleeve, and check valve means allowing fluid to flow upwardly through the mud saver valve when the fluid passageway is closed and the fluid pressure downhole of the mud saver valve exceeds a predetermined fluid pressure, said spear head including a retaining sleeve having an inwardly disposed annular shoulder engaging said spear sleeve and said spear sleeve having an outwardly disposed annular shoulder engaging said spear sleeve and said spear sleeve having an outwardly disposed annular shoulder engaging said retaining sleeve, said retaining sleeve matingly receiving said spear sleeve to telescopically mount said spear head to said spear sleeve, said annular shoulders cooperating to limit the telescoping movement of said spear head relative to said spear sleeve.

19. The closure plug as defined in claim 18 wherein said check valve means includes at least one fluid port formed in said retaining sleeve of said spear head, said at least one port being opened as said spear head extends relative to said spear sleeve and said at least one port being closed as said spear head telescopically contracts relative to said spear sleeve.

20. The closure plug as defined in claim 18 wherein said spear is retained within the upper end of the mud saver valve by at least one upper end of the mud saver valve by at least one shear screw extending from the upper end of the mud saver valve to engage said spear sleeve.

* * * * *